US008974269B2

(12) United States Patent
Lee

(10) Patent No.: US 8,974,269 B2
(45) Date of Patent: Mar. 10, 2015

(54) METHOD FOR SURFACE-TREATING MIRROR-FINISH STAINLESS STEEL WORKPIECE

(71) Applicant: Chun Pei Lee, Taipei County (TW)

(72) Inventor: Chun Pei Lee, Taipei County (TW)

(73) Assignee: Chun Pei Lee, Taipei County (TW)

( * ) Notice: Subject to any disclaimer, the term of this patent is extended or adjusted under 35 U.S.C. 154(b) by 208 days.

(21) Appl. No.: 13/668,910

(22) Filed: Nov. 5, 2012

(65) Prior Publication Data

US 2013/0059504 A1 Mar. 7, 2013

Related U.S. Application Data

(63) Continuation-in-part of application No. 12/829,211, filed on Jul. 1, 2010, now abandoned.

(30) Foreign Application Priority Data

May 7, 2010 (TW) ..... 99115728 A

(51) Int. Cl.
*B24B 1/00* (2006.01)
*B24B 7/00* (2006.01)
*B24B 29/02* (2006.01)

(52) U.S. Cl.
CPC .. *B24B 29/02* (2013.01); *B24B 1/00* (2013.01)
USPC ..... 451/57; 451/59

(58) Field of Classification Search
CPC ..... B24B 29/00; B24B 29/02; B24B 1/00
USPC ..... 451/57, 28
See application file for complete search history.

(56) References Cited

U.S. PATENT DOCUMENTS

| | | | | |
|---|---|---|---|---|
| 3,088,158 | A * | 5/1963 | Boyle et al. | 15/104.93 |
| 3,882,648 | A * | 5/1975 | Buchinski et al. | 451/59 |
| 5,792,334 | A * | 8/1998 | Asai et al. | 205/206 |
| 6,083,890 | A * | 7/2000 | Miskiel et al. | 510/108 |
| 2011/0275282 | A1* | 11/2011 | Popov et al. | 451/28 |

OTHER PUBLICATIONS

"Buffing Kit Instructions: Part #50341." Dec. 2008. Eastwood. <http://www.eastwood.com/images/pdf/50341Q%20Deluxe%20Polishing%20Kit.pdf>.*
"Polishing (metalworking)." Nov. 4, 2009. Wikipedia.org. <http://en.wikipedia.org/wiki/Polishing_(metalworking)>.*
"Buffing & Polishing Rouges & Compounds." Apr. 12, 2001. AJH Knives. <http://www.ajh-knives.com/buffing-1.html>.*
"Helping cleaning stains on 1962 Gillette Slim Adjustable." Dec. 27, 2009. BadgerandBlade.com <http://badgerandblade.com/vb/archive/index.php/t-124403.html>.*

(Continued)

*Primary Examiner* — Lee D Wilson
*Assistant Examiner* — Joel Crandall
(74) *Attorney, Agent, or Firm* — Hannah M. Tien

(57) ABSTRACT

The present invention discloses a method for surface-treating a mirror-finish stainless steel workpiece, which comprises steps: dividing the surface of a mirror-finish stainless steel workpiece into different grinding areas according to the depths of the scratches; selecting sand papers respectively having appropriate grit sizes for the grinding areas, and grinding the grinding areas to remove all the scratches; sequentially using three combinations of polishing agents and grinding materials to undertake polishing; and using an abrasive paste and a fourth grinding material to perform mirror-finishing.

8 Claims, 7 Drawing Sheets

(56) References Cited

OTHER PUBLICATIONS

"How to Clean Stainless Steel." Oct. 10, 2007. HowToCleanStuff.net. <http://www.howtocleanstuff.net/how-to-clean-stainless-steel/>.*

Debold, Terry A., and James W. Martin. "How to Passivate Stainless Steel Parts." Oct. 1, 2003. Modern Machine Shop. <http://www.mmsonline.com/articles/how-to-passivate-stainless-steel-parts>.*

"Machine Polishing With Bar Rouge." Sep. 11, 2012. Zephyr Sales Company, Inc. <https://www.zephyrpro40.com/pdf/machinepolishing.pdf>.*

"Tips and Tricks." Southwest Metal Finishing Supply Co. <http://www.swmetal.com/category-s/1865.htm>.*

Rizzo, Jim. "Shining with Skill." Apr. 2000. Popular Hot Rodding. <http://clubs.hemmings.com/overthehillgangsdnc/ClubInfo/Links/Popular%20Hot%20Rodding%20Shining%20with%20Skill.htm>.*

* cited by examiner

METHOD FOR SURFACE-TREATING MIRROR-FINISH STAINLESS STEEL WORKPIECE

CROSS-REFERENCE TO RELATED APPLICATIONS

This application is a Continuation-in-Part application of the pending U.S. patent application Ser. No. 12/829,211 filed on Jul. 1, 2010, all of which is hereby incorporated by reference in its entirety. Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of the entire prior art of record and any search that the Office deems appropriate.

BACKGROUND OF THE INVENTION

1. Field of the Invention

The present invention relates to a method for surface-treating a mirror-finish stainless steel workpiece, particularly to a method using a series of grinding steps to polish and mirror-finish the surface of a stainless steel workpiece.

2. Description of the Related Art

Some mirror-finish stainless steel workpieces, such as an electric elevator, are unlikely to be fabricated in form of an integral one-piece body but are usually assembled piece by piece with welding. The irregularities caused by welding degrade appearance esthetics and thus need to be finished with grinding, coarse polishing, fine polishing, etc. In the conventional grind-polish technology, tool marks, such as grinding marks and polishing marks, still remain on the fine-polished surface. Further, over-grinding may cause over-heating and distortion on the surface of the mirror-finish stainless steel workpiece. Besides, the conventional grind-polish technology cannot indeed achieve a mirrorlike surface.

On the other side, the stainless steel workpieces, which have been installed in a building, usually have scribed marks, abrasion, corrosion, pollution, etc., on the surface thereof. However, the conventional grind-polish technology is hard to maintain or repair the surface of an electric elevator in situ.

"Buffing Kit Instructions: Part #50341" disclosed a buff and compound to polish and grind a surface by using a leaf buff, a wool buff, sisal buff, a muslin, etc. to grind. But, it left polishing traces. Furthermore, it did not disclose to use a sponge having a density from 35 kg/m$^3$ to 45 kg/m$^3$ to polish or grind a mirror-finish stainless steel workpiece.

Accordingly, the present invention proposes an innovative method for surface-treating a mirror-finish stainless steel workpiece, which can overcome the conventional problems, and which can promote the esthetics of the polished surface and facilitate in-situ polishing.

SUMMARY OF THE INVENTION

Based on many years' experience in the related field and with persistent research and experiment, the Inventor has been devoted to improving the surface treatment technology and thus proposes a method for surface-treating a mirror-finish stainless steel workpiece of the present invention.

The primary objective of the present invention is to provide a method for surface-treating a mirror-finish stainless steel workpiece, which uses both mechanical and chemical methods to promote the appearance esthetics of a workpiece and achieve a mirrorlike surface.

Another objective of the present invention is to provide a method for surface-treating a mirror-finish stainless steel workpiece, which uses both mechanical and chemical methods to prevent from distortions or recessions caused by over grinding.

A further objective of the present invention is to provide a method for surface-treating a mirror-finish stainless steel workpiece, which can perform surface polishing in situ without dismounting the workpiece.

It is an further objective of the present invention to provide a method for surface-treating a mirror-finish stainless steel workpiece, comprising steps:

(12) applying an abrasive paste to all grinding areas, and letting said abrasive paste stay still on all said grinding areas for a given period of time; and

(13) using a fourth grinding material to perform mirror-finishing on all said grinding areas, wherein the fourth grinding material is a sponge having a density from 35 kg/m$^3$ to 45 kg/m$^3$.

To achieve the abovementioned objectives, the present invention proposes a method for surface-treating a mirror-finish stainless steel workpiece, which comprises at least the following steps: (1) dividing the surface of a mirror-finish stainless steel workpiece into different grinding areas according to the depths of the scratches; (2) selecting a sand paper having an appropriate grit size for one grinding area, and using a grinder and the sand paper to grind the grinding area; (3) examining whether all the scratches on the grinding area have been eliminated; undertaking Step (5) if the answer is yes; undertaking Step (4) if the answer is no; (4) selecting a sand paper having a greater grit size, and using a grinder and the sand paper to grind the grinding area again, and then undertaking Step (3); (5) examining whether the scratches of all the grinding areas have been eliminated; undertaking Step (6) if the answer is yes; undertaking Step (2) if the answer is no; (6) applying a first polishing agent to all the grinding areas; (7) using a grinder and a first grinding material to eliminate the sand abrasions from all the grinding areas; (8) applying a second polishing agent to all the grinding areas; (9) using a grinder and a second grinding material to eliminate all the marks scribed by the first grinding material from all the grinding areas; (10) applying a third polishing agent to all the grinding areas; (11) using a grinder and a third grinding material to perform a final grinding on all the grinding areas; (12) applying an abrasive paste to all the grinding areas, and letting the abrasive paste stay still on all the grinding areas for a given period of time; (13) using a fourth grinding material to perform mirror-finishing on all the grinding areas, wherein the fourth grinding material is a sponge having a density from 35 kg/m$^3$ to 45 kg/m$^3$.

According to the method of the present invention, preferably said first polishing agent used in said step (6) is a polishing agent comprising of aluminum oxide particles suspended in stearine, waxes and fats that can fast cut various metals and generates medium brightness.

According to the method of the present invention, preferably said first grinding material used in said step (7) is a sisal buff.

According to the method of the present invention, preferably said second polishing agent used in said step (8) is a polishing agent comprising aluminum oxide particles suspended in stearine, waxes and fats that has high grinding efficiency, can fast remove scratches on a surface of a metal, and generates lower brightness.

According to the method of the present invention, preferably said second grinding material used in said step (9) is a cotton buff.

According to the method of the present invention, preferably said third polishing agent used in said step (10) is a polishing agent comprising aluminum oxide particles suspended in stearine, waxes and fats that can fast cut various metals, contains less wax having a wax content less than that of the second polishing agent, and generates a very clean surface having medium brightness.

According to the method of the present invention, preferably said third grinding material used in said step (11) is a wool buff.

According to the method of the present invention, preferably said abrasive paste used in said step (12) contains at least diluted nitric acid, alumina powder, xanthan gum, water, bentonite, and fragrance.

According to the method of the present invention, preferably said given period of time in said step (12) is 30-60 minutes.

According to the method of the present invention, preferably said fourth grinding material used in said step (13) is a high-density and tough sponge.

DETAILED DESCRIPTION OF THE INVENTION

To achieve the abovementioned objectives and efficacies, the Inventor has persistently improved the conventional technologies and thus proposes a method for surface-treating a mirror-finish stainless steel workpiece, which uses a plurality of polishing agents, grinding materials, and abrasive pastes to enhance the polishing effect. Below, two embodiments are used to demonstrate the technical principles and process of the present invention.

Figure 1A:
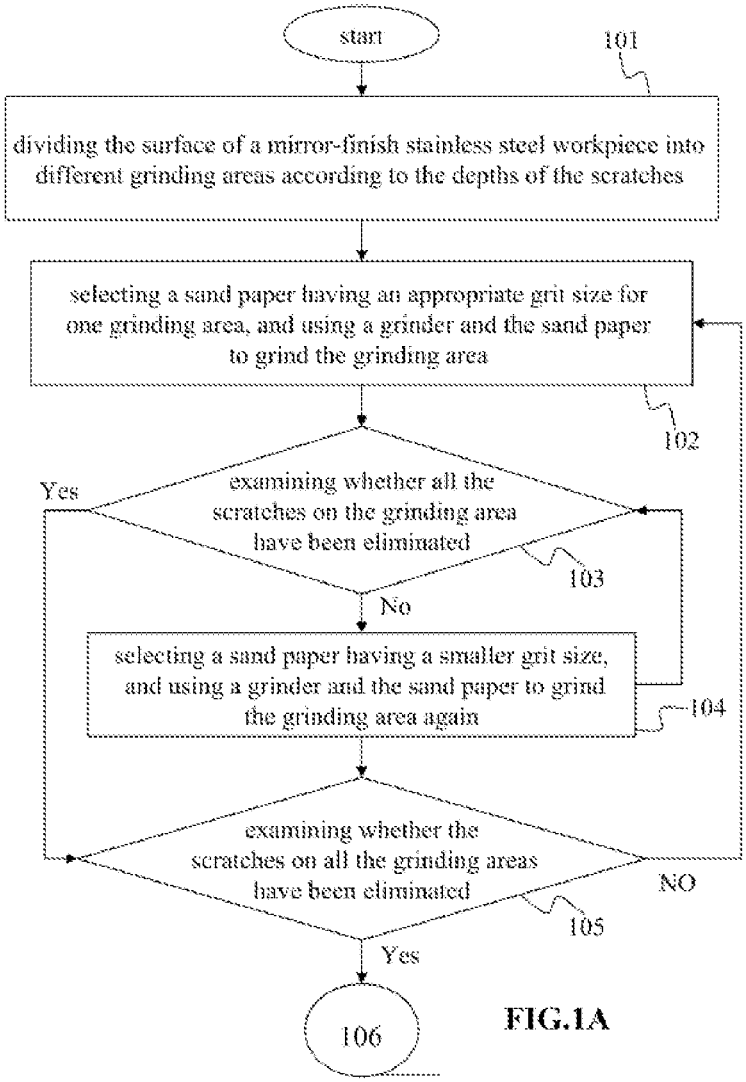
FIG. 1A and FIG. 1B are diagrams jointly showing a flowchart of a method for surface-treating a mirror-finish stainless steel workpiece according to a first embodiment of the present invention.
Figure 1B:
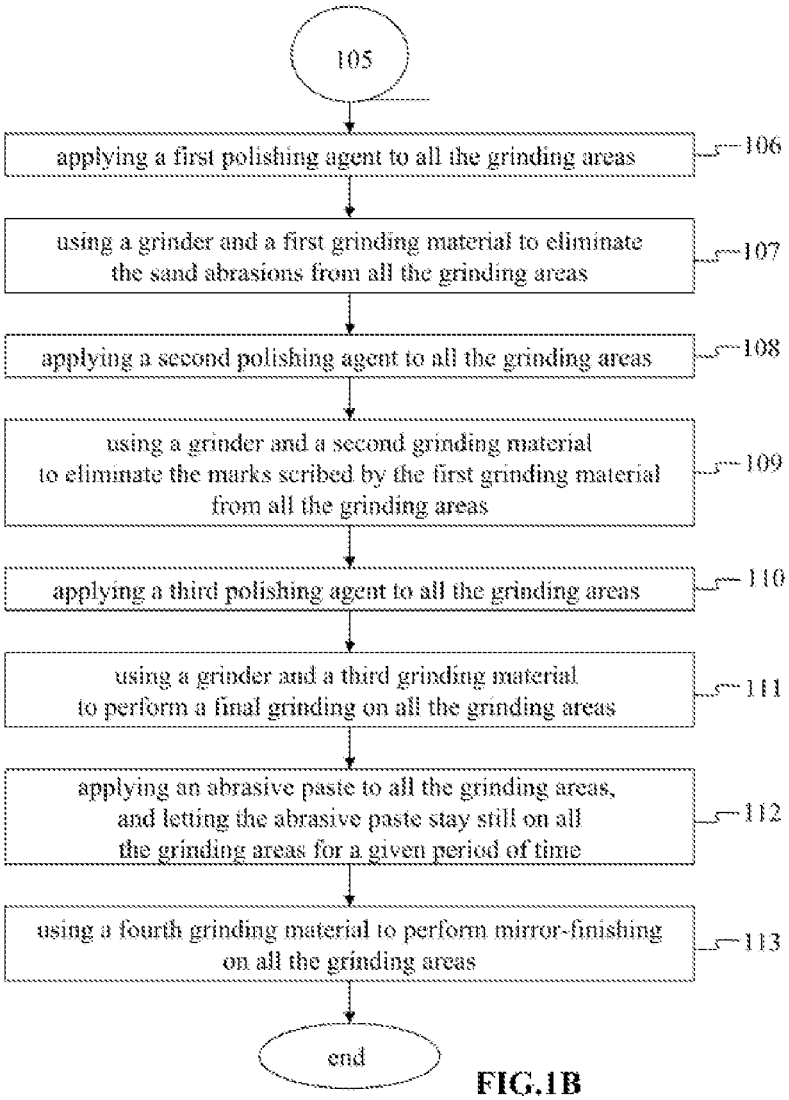

Refer to FIG. 1A and FIG. 1B jointly showing a flowchart of a method for surface-treating a mirror-finish stainless steel workpiece according to a first embodiment of the present invention. The method of the present invention comprises steps: dividing the surface of a mirror-finish stainless steel workpiece into different grinding areas according to the depths of the scratches (Step 101); selecting a sand paper having an appropriate grit size for one grinding area, and using a grinder and the sand paper to grind the grinding area (Step 102); examining whether all the scratches on the grinding area have been eliminated (Step 103); undertaking Step 105 if the answer is yes; undertaking Step 104 if the answer is no; selecting a sand paper having a greater grit size, and using a grinder and the sand paper to grind the grinding area again (Step 104), and then performing Step 103; examining whether the scratches on all the grinding areas have been eliminated (Step 105); undertaking Step 106 if the answer is yes; undertaking Step 102 if the answer is no; applying a first polishing agent to all the grinding areas (Step 106); using a grinder and a first grinding material to eliminate the sand abrasions from all the grinding areas (Step 107); applying a second polishing agent to all the grinding areas (Step 108); using a grinder and a second grinding material to eliminate the marks scribed by the first grinding material from all the grinding areas (Step 109); applying a third polishing agent to all the grinding areas (Step 110); using a grinder and a third grinding material to perform a final grinding on all the grinding areas (Step 111); applying an abrasive paste to all the grinding areas, and letting the abrasive paste stay still on all the grinding areas for a given period of time (Step 112); using a fourth grinding material to perform mirror-finishing on all the grinding areas (Step 113).

In the first embodiment, the first polishing agent adopted in Step 106 is of a BRIGHT-CUT grade (Red bars, consisting of aluminum oxide particles suspended in stearine, waxes and fats), which can fast cut various metals and generates medium brightness. The first grinding material used in Step 107 is a sisal buff, which cooperates with the BRIGHT CUT agent (Red bars, consisting of aluminum oxide particles suspended in stearine, waxes and fats) to smooth all the sand abrasions on all the grinding areas. The second polishing agent adopted in Step 108 is of a FASTCUT grade (Grey bars, consisting of aluminum oxide particles suspended in stearine, waxes and fats), which has high grinding efficiency and can fast remove the scratches on the surface of a metal, generating lower brightness. The second grinding material used in Step 109 is a cotton buff, which cooperates with the FASTCUT agent (Grey bars, consisting of aluminum oxide particles suspended in stearine, waxes and fats) to remove the marks scribed on all the grinding areas by the first grinding material. The third polishing agent adopted in Step 110 is of a WHITE CUTTER P2 grade (white bars, consisting of aluminum oxide particles suspended in stearine, waxes and fats), which can fast cut various metals, contains less wax, and generates a very clean surface having medium brightness. The third grinding material used in Step 111 is a wool buff, which cooperates with the WHITE CUTTER P2 agent (white bars, consisting of aluminum oxide particles suspended in stearine, waxes and fats) to perform a final grinding on all the grinding areas.

In the first embodiment, the abrasive paste used in Step 112 contains at least diluted nitric acid, alumina powder, xanthan gum, water, bentonite, and essence. After applied to all the grinding areas, the abrasive paste stays still on the surface of the workpiece for 30-60 minutes. Then, the process proceeds to Step 113. The fourth grinding material used in Step 113 is a high-density and tough sponge, which cooperates with the abrasive paste to perform mirror-finishing on all the grinding areas. Thus is achieved a highly reflective mirrorlike surface on a stainless steel workpiece.

Figure 2A:
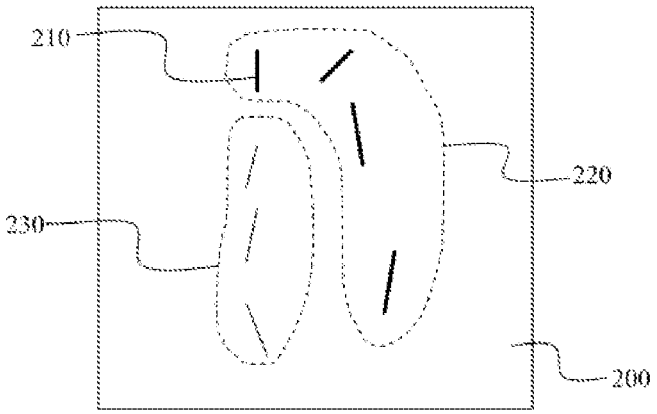
FIGS. 2A-2F are diagrams schematically showing the steps of the method according to the first embodiment of the present invention.
Figure 2B:
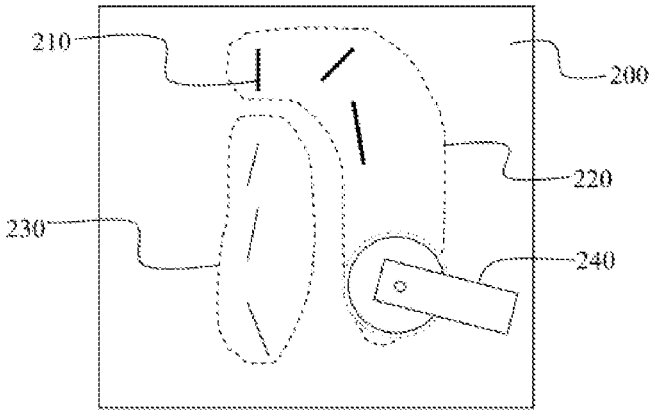
Figure 2C:
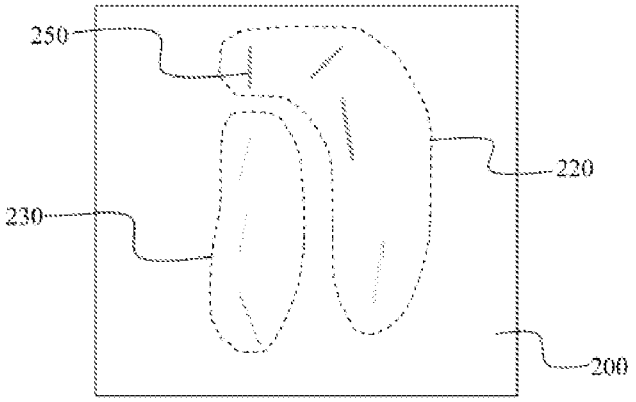
Figure 2D:
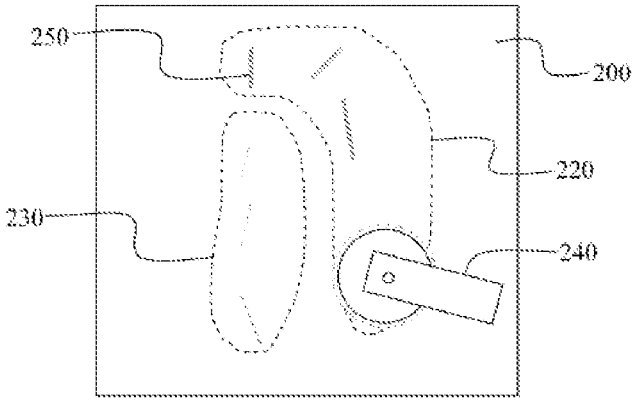
Figure 2E:
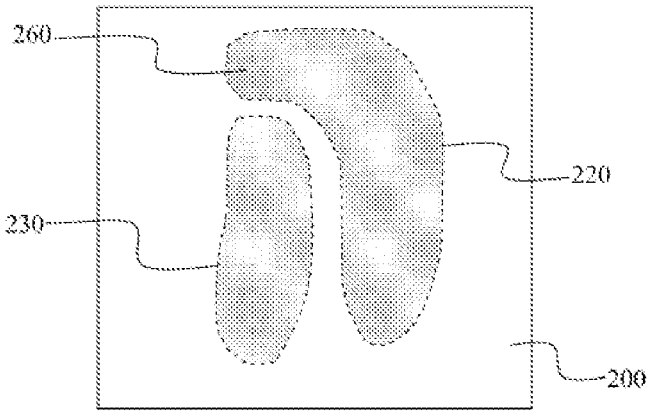
Figure 2F:
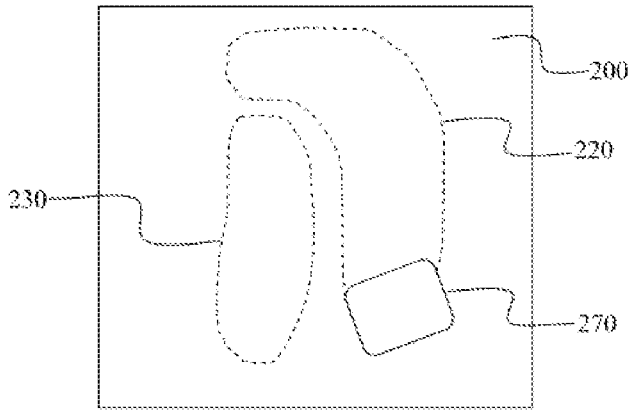

Refer to FIGS. 2A-2F diagrams schematically showing the steps of the method according to the first embodiment of the present invention. As shown in FIG. 2A, a surface 200 of a stainless steel workpiece has a plurality of scratches 210. In Step 101, the surface 200 is divided into two different grinding areas 220 and 230 according to the depths of the scratches 210. FIG. 2B schematically shows Step 102-Step 105, wherein a grinder 240 and a sand paper (not shown in the drawings) having an appropriate grit size are used to grind the grinding area 220 and 230 and eliminate all the scratches 210. As shown in FIG. 2C, the grinder 240 and the sand paper remove the scratches 210 but leave sand abrasions 250. As shown in FIG. 2D, the grinder 240 cooperates with a plurality of grinding materials and a plurality of polishing agents to smooth the sand abrasions 250 in Steps 106-111. As shown in FIG. 2E, after the sand abrasions 250 have been completely smoothed, an abrasive paste 260 is applied to the grinding areas 220 and 230 and stays still on the grinding areas 220 and 230 for a given period of time. As shown in FIG. 2F, a grinding material (a piece of sponge) and the abrasive paste 260 are used to perform mirror-finishing on the two grinding areas 220 and 230. Thus is achieved a highly reflective mirrorlike surface 200 on the stainless steel workpiece.

Figure 3A:
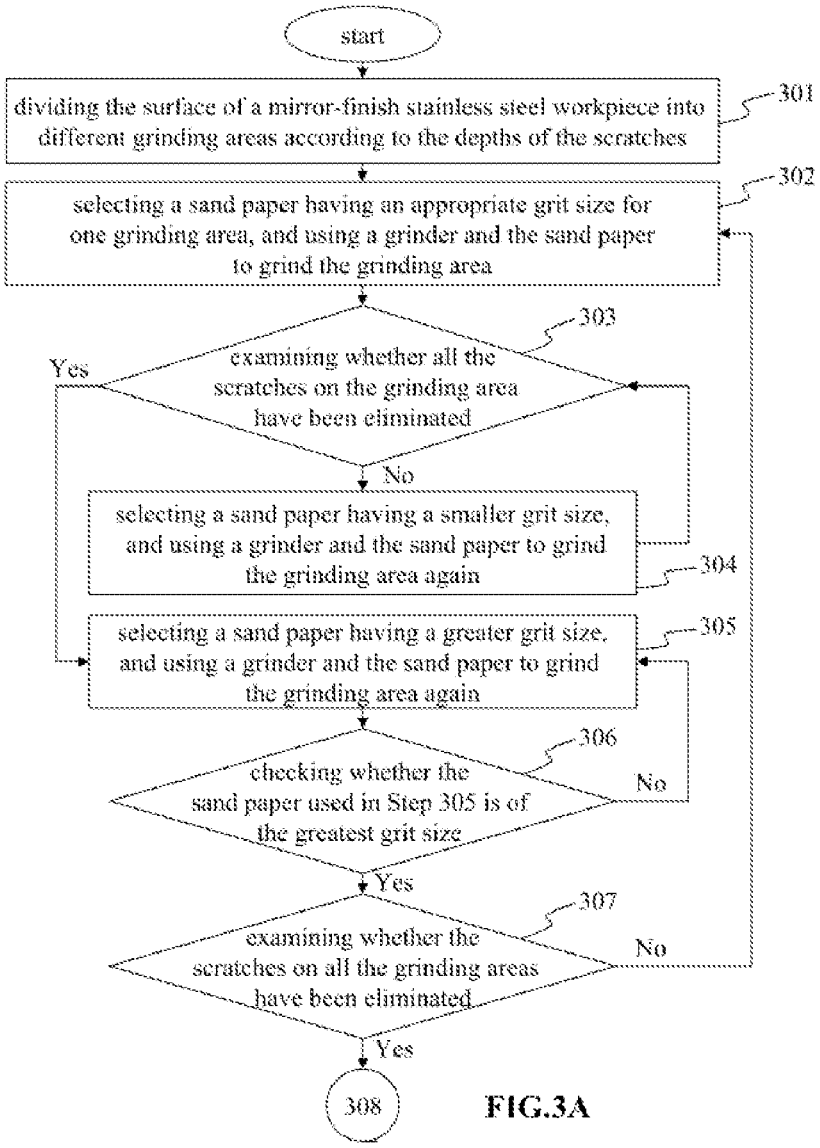
FIG. 3A and FIG. 3B are diagrams jointly showing a flowchart of a method for surface-treating a mirror-finish stainless steel workpiece according to a second embodiment of the present invention.
Figure 3B:
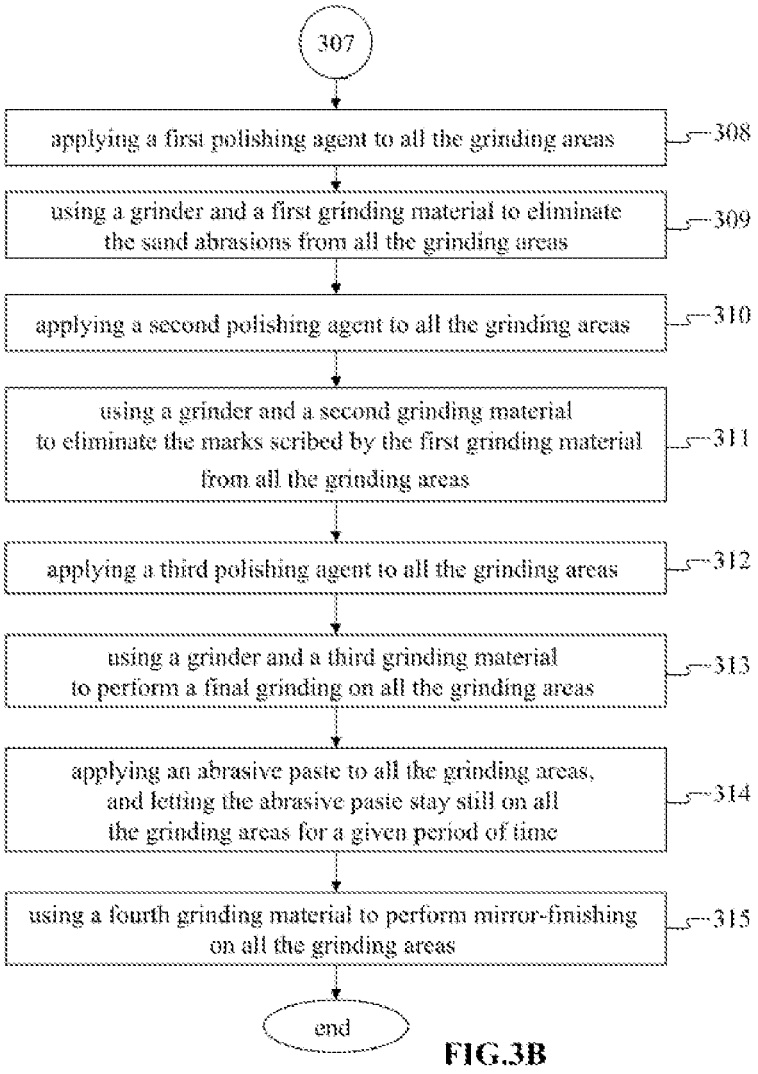

Refer to FIG. 3A and FIG. 3B jointly showing a flowchart of a method for surface-treating a mirror-finish stainless steel workpiece according to a second embodiment of the present invention. The method of the present invention comprises steps: dividing the surface of a mirror-finish stainless steel workpiece into different grinding areas according to the depths of the scratches (Step 301); selecting a sand paper having an appropriate grit size for one grinding area, and using a grinder and the sand paper to grind the grinding area (Step 302); examining whether all the scratches on the grinding area have been eliminated (Step 303); undertaking Step 305 if the answer is yes; undertaking Step 304 if the answer is no; selecting a sand paper having a greater grit size, and using a grinder and the sand paper to grind the grinding area again (Step 304), and then undertaking Step 303; selecting a sand paper having a smaller grit size, and using a grinder and the sand paper to grind the grinding area again (Step 305); checking whether the sand paper used in Step 305 is of the smallest grit size (Step 306); undertaking Step 307 if the answer is yes; undertaking Step 305 if the answer is no; examining whether the scratches on all the grinding areas have been eliminated (Step 307); undertaking Step 308 if the answer is yes; undertaking Step 302 if the answer is no; applying a first polishing agent to all the grinding areas (Step 308); using a grinder and a first grinding material to eliminate the sand abrasions from all the grinding areas (Step 309); applying a second polishing agent to all the grinding areas (Step 310); using a grinder and a second grinding material to eliminate the marks scribed by the first grinding material from all the grinding areas (Step 311); applying a third polishing agent to all the grinding areas (Step 312); using a grinder and a third grinding material to perform a final grinding on all the grinding areas (Step 313); applying an abrasive paste to all the grinding areas, and letting the abrasive paste stay still on all the grinding areas for a given period of time (Step 314); using a fourth grinding material to perform mirror-finishing on all the grinding areas (Step 315).

In the second embodiment, the first polishing agent adopted in Step 308 is of a BRIGHT-CUT grade, which can fast cut various metals and generates medium brightness. The first grinding material used in Step 309 is a sisal buff, which cooperates with the BRIGHT CUT agent (Red bars, consisting of aluminum oxide particles suspended in stearine, waxes and fats) to smooth all the sand abrasions on all the grinding areas. The second polishing agent adopted in Step 310 is of a FASTCUT grade (Grey bars, consisting of aluminum oxide particles suspended in stearine, waxes and fats), which has high grinding efficiency and can fast remove the scratches on the surface of a metal, generating lower brightness. The second grinding material used in Step 311 is a cotton buff, which cooperates with the FASTCUT agent to remove the marks scribed on all the grinding areas by the first grinding material. The third polishing agent adopted in Step 312 is of a WHITE CUTTER P2 grade (white bars, consisting of aluminum oxide particles suspended in stearine, waxes and fats), which can fast cut various metals, contains less wax, and generates a very clean surface having medium brightness. The third grinding material used in Step 313 is a wool buff, which cooperates with the WHITE CUTTER P2 agent to perform a final grinding on all the grinding areas.

In the second embodiment, the abrasive paste used in Step 314 contains at least diluted nitric acid, alumina powder, xanthan gum, water, bentonite, and essence. After applied to all the grinding areas, the abrasive paste stays still on the surface of the workpiece for 30-60 minutes. Then, the process proceeds to Step 315. The fourth grinding material used in Step 315 is a high-density and tough sponge, which cooperates with the abrasive paste to perform mirror-finishing on all the grinding areas. Thus is achieved a highly reflective mirrorlike surface on a stainless steel workpiece.

From the above description, it is known that the present invention has the following advantages:

1. The present invention grinds and polishes the surface of a stainless steel workpiece in mechanical and chemical ways and thus can prevent from recessions and distortions caused by over grinding.
2. The present invention can maintain or repair the surface of a stainless steel workpiece in situ without dismounting the workpiece.
3. The conventional technology usually attaches additional layers on the surface of an electric elevator. The additional layers increase the weight of the electric elevator, make the electric elevator consume more power, and shorten the service life of the electric elevator. The present invention does not use additional layers and is thus exempt from the abovementioned problems.
4. The present invention can repair a seriously scratched or polluted object. Thus, the user can keep on using the object and needn't spend money on replacing the object.
5. The present invention can polish a scratched region locally to resume the mirrorlike surface without generating a luster difference between the polished and unpolished regions. As the present invention needn't process the total surface of an object, it can repair the object more economically and efficiently.
6. The present invention can achieve a real mirrorlike surface because the present invention can repair the surface of an object without leaving any tool mark, such as sand abrasions, random scratches, polishing marks, etc., on the surface of the object.

EXAMPLE

In order to erase scratches and to recover and to be buffed to a mirror shine, a manual polishing machine needs two kinds of polishing methods of the present invention. One is vertical-type polishing (1000-2500 rpm) and the other is rotary-type polishing (800-1000 rpm). To collectively use the above two kinds of polishing methods, a real mirror shine without scratches can be obtained.

A method of processing mirror-finish stainless steel having scratches of the present invention is to use chemical polishing method comprising steps of reacting a diluted nitric acid with a surface of the stainless steel to coat and to form special chemical oxidation reaction and mirror-finish grinding the surface with a H-T40 sponge (preferably dry after wetting) in combination with mechanical polishing method (to erase scratches and to grind the scratches into smooth surface). A compound slurry, in combination with a slightly wetting H-T40 sponge having a middle or low density is used to grind at 800-1000 rpm in order to decrease a surface grinding temperature greatly and to avoid generating recess due to high temperature on the stainless steel surface. After repeating the above steps 2-3 times, a real mirror-finish shine is obtained.

The sponge used as fourth grinding material in step 13 has a density from 35 $kg/m^3$ to 45 $kg/m^3$. The sponge is commercially available from Homing Spomge Inc located at New Taipei City, Taiwan. The composition of the sponge comprises Poiypropy Lene Gljycol (tradename), Tdluene Diisocyanate (tradename), Silicone (tradename), Amine (tradename), and Catavct (tradename). The objective of usage of the sponge is to grinds and polishes the white mist surface of a stainless steel workpiece by means of a polishing agent to recover the mirror-like surface to chromium color polish. The sponge is a medium used in polishing and grinding and to clean the dirty matter and to coat and apply. The sponge can be used for a long time having a certain density and strength, and not easily degrade or to generate a new scratches. The sponge can obtain a excellent surface-treating processing on a large surface without generating a color difference. The sponge can absorb vibration of the hand-grinding machine to transfer heat easily on the working surface. The workpiece can not be easily distorted.

The polishing effects of this invention are listed as follows: Brightness of an inside stainless steel of an elevator was measured after polishing processing.

TABLE 1

| brightness of a stainless steel workpiece of this invention | brightness of a stainless steel workpiece of prior arts |
|---|---|
| 1364 gu | 413 gu |

From the above Table 1, the polishing effect (brightness, 1364 gu) of this invention is much better than that (413 gu) of prior arts.

The embodiments described above are only to demonstrate the technical contents and characteristics of the present invention to enable the persons skilled in the art to understand, make, and use the present invention. However, these embodiments are not intended to limit the scope of the present invention. Therefore, any equivalent modification or variation according to the spirit of the present invention is to be also included within the scope of the present invention.

What is claimed is:

1. A method for surface-treating a mirror-finish stainless steel workpiece in situ, comprising steps:

(1) dividing a surface of a mirror-finish stainless steel workpiece into different grinding areas according to depths of scratches;

(2) a first mechanical polishing step comprising:

(a) selecting a first sand paper having an appropriate grit size for one of said grinding areas, and using a hand-held polishing machine and said first sand paper to grind said grinding area, wherein said hand-held polishing machine performs vertical-type polishing at 1000-2500 rpm;

(b) examining whether all scratches on said grinding area have been eliminated; undertaking Step (d) if the answer is yes; undertaking Step (c) if the answer is no;

(c) selecting a second sand paper having a greater grit size, and using said hand-held polishing machine and said second sand paper to grind said grinding area again, and then undertaking Step (b);

(d) examining whether scratches of all said grinding areas have been eliminated; undertaking Step (i) if the answer is yes; undertaking Step (a) if the answer is no;

(3) a second mechanical polishing step comprising:

(i) applying a first polishing agent to all said grinding areas;

(ii) using said hand-held polishing machine and a first grinding material to eliminate sand abrasions from all said grinding areas;

(iii) applying a second polishing agent to all said grinding areas;

(iv) using said hand-held polishing machine and a second grinding material to eliminate marks scribed by said first grinding material from all said grinding areas;

(v) applying a third polishing agent to all said grinding areas;

(vi) using said hand-held polishing machine and a third grinding material to perform a final grinding on all said grinding areas before step (4);

(4) a chemical-mechanical polishing step comprising:

(A) applying an abrasive paste to all grinding areas, and letting said abrasive paste stay still on all said grinding areas for 30 to 60 minutes; and (B) using a hand-held grinder and a fourth grinding material to perform mirror-finishing on all said grinding areas, wherein the fourth grinding material is a sponge having a density from 35 kg/m$^3$ to 45 kg/m$^3$, wherein said grinder performs rotary-type polishing at 800-1000 rpm; wherein the abrasive paste contains at least diluted acid, alumina powder, xanthan gum, water, bentonite, and fragranee to react with all said grinding areas to coat and to form chemical oxidation reaction.

2. The method for surface-treating a mirror-finish stainless steel workpiece according to claim 1, wherein said first polishing agent used in said step (i) is a polishing agent comprising aluminum oxide particles suspended in stearine, waxes and fats that can fast cut various metals and generates medium brightness.

3. The method for surface-treating a mirror-finish stainless steel workpiece according to claim 1, wherein said first grinding material used in said step (ii) is a sisal buff.

4. The method for surface-treating a mirror-finish stainless steel workpiece according to claim 1, wherein said second polishing agent used in said step (iii) is a polishing agent comprising aluminum oxide particles suspended in stearine, waxes and fats that has high grinding efficiency, can fast remove scratches on a surface of a metal, and generates lower brightness.

5. The method for surface-treating a mirror-finish stainless steel workpiece according to claim 1, wherein said second grinding material used in said step (iv) is a cotton buff.

6. The method for surface-treating a mirror-finish stainless steel workpiece according to claim 1, wherein said third polishing agent used in said step (v) is a polishing agent comprising aluminum oxide particles suspended in stearine, waxes and fats that can fast cut various metals, contains less wax having a wax content less than that of the second polishing agent, and generates a very clean surface having medium brightness.

7. The method for surface-treating a mirror-finish stainless steel workpiece according to claim 1, wherein said third grinding material used in said step (vi) is a wool buff.

8. The method for surface-treating a mirror-finish stainless steel workpiece according to claim 1, wherein said diluted acid is diluted nitric acid.

* * * * *